United States Patent [19]

Wünsche

[11] Patent Number: 4,643,135

[45] Date of Patent: Feb. 17, 1987

[54] INTERNAL COMBUSTION ENGINE

[75] Inventor: Peter Wünsche, Graz, Austria

[73] Assignee: AVL Gesellschaft für Verbrennungskraftmaschinen und Messtechnik m.b.H. Prof. Dr. Dr. h.c. Hans List, Graz, Austria

[21] Appl. No.: 785,951

[22] Filed: Oct. 10, 1985

[30] Foreign Application Priority Data

Oct. 17, 1984 [AT] Austria ..... 3310/84

[51] Int. Cl.[4] ..... F01P 5/10

[52] U.S. Cl. ..... 123/41.44; 123/41.47

[58] Field of Search ..... 123/41.44, 198 C, 41.47; 416/3; 417/420, 356; 464/29

[56] References Cited

U.S. PATENT DOCUMENTS

| | | | |
|---|---|---|---|
| 2,033,577 | 3/1936 | Hunter | 416/3 |
| 2,656,825 | 10/1953 | Hartz | 123/41.44 |
| 3,723,029 | 3/1973 | Laing | 417/420 |
| 3,860,064 | 1/1975 | Murphy | 417/420 |
| 4,095,922 | 6/1978 | Farr | 417/313 |
| 4,120,618 | 10/1978 | Klaus | 417/420 |

FOREIGN PATENT DOCUMENTS

| | | | |
|---|---|---|---|
| 513224 | 3/1954 | France | 417/420 |

*Primary Examiner*—William A. Cuchlinski, Jr.
*Attorney, Agent, or Firm*—Watson, Cole, Grindle & Watson

[57] ABSTRACT

A known feature of internal combustion engines is that the cooling-water pump has an impeller which is rigidly connected with a squirrel cage rotor and which is driven without physical contact via the rotatory field of rotating permanent magnets. If such an engine is additionally provided with a flywheel generator, construction of the cooling-water pump is greatly simplified according to this invention, as the permanent magnets of the flywheel generator are simultaneously utilized for driving the impeller, and the water pump is positioned in a concentric recess of the flywheel, thereby saving space.

3 Claims, 2 Drawing Figures

INTERNAL COMBUSTION ENGINE

BACKGROUND OF THE INVENTION

This invention relates to an internal combustion engine with a cooling-water pump whose housing is attached to the engine housing and comprises a squirrel cage rotor which is rigidly connected with the impeller of the pump und can be driven without physical contact via the rotatory field of rotating permanent magnets.

DESCRIPTION OF THE PRIOR ART

The cooling water pump described in German laid-open print DE-OS 2 109 341 has a pole ring which is made from a permanently magnetic material and is located in a semispherical housing. This pole ring is configured as an iron ring shaped like a spherical segment in which are embedded copper bars whose ends are connected by copper rings, and is rigidly mounted on a shaft which is held in the pumpe housing by two bearings and is driven via a flanged-on V-belt pulley. On the outer circumference of the iron ring the pumpe blades are arranged. This known type of cooling-water pump which is sealed hermetically and has no losses due to leakage or faulty sealing, can be perfectly adjusted to the amount of circulation water actually required for cooling the engine, by proper dimensioning of the eddy-current element. This disadvantage of this design is that a variety of components are necessary for building a water pump as specified in the above laid-open print.

SUMMARY OF THE INVENTION

It is an object of the present invention to maintain the advantages of the known type of combustion engine while finding a configuration that will reduce the expense for bearing and driving the water pump and minimize the required space.

According to the invention this task is solved by making the permanent magnets part of a flywheel generator and by placing the housing of the water pump with its —preferably floating—impeller in a concentric recess of the generator flywheel that is positioned next to the permanent magnets.

Permanent magnets as part of a flywheel generator are known from AT-PS 138 299, for instance. Small-size engines, above all, such as they are used in motor cycles, lawn mowers or power saws, etc., often have combined generator/flywheel units or so-called flywheel generators, which permits a simpler design of the bearing, lubricating and driving system. In such instances the flywheel also serves as a magnet wheel, the permanent magnets attached to the flywheel generating a rotatory field for induction of A/C voltage into the stationary generator armatures carried by a plate that is mounted in a position concentric to the crankshaft.

The disadvantage of such internal combustion engines with individual units for the generation of current required for operating the electric systems of the engine, and for the circulation of cooling water, is that a variety of components are necessary for bearing, lubricating and driving these units.

If the existing components of the flywheel generator are utilized, however, (which in itself is of a known type, of course), the construction of the water pumpe can be kept very simple, and no separate bearing and drive elements are needed for the magnet wheel. The use of floating bearings for the impeller will eliminate sliding friction, and considerably less energy will therefore be required for driving the impeller. Besides, the invention will permit a most compact design of the water pumpe which is mounted inside the flywheel generator. The outer dimension of the combustion engine in the direction of the crankshaft need not be increased. As the pumpe housing is screw-fastened to the wall of the crankcase, pressure and intake channels may be cast integral with the wall of the crankcase, and the necessary inlets and outlets may be drilled.

In a development of the invention the housing of the water pump is located within the enveloping surface formed by the rotation permanent magnets. In this preferred variant the efficiency of both units, i.e. the flywheel generator as well as the water pumpe, will be satisfactory for a given engine speed.

According to another proposal of the invention the impeller of the water pump is a plastic component into which the squirrel cage rotor is incorporated. This permits a very simple construction of an impeller with an integrated squirrel cage rotor, the simplest type of rotor consisting of two cylindrical strips of sheet metal connected by webs.

The Housing of the water pumpe may also be made of plastic, which will simplify manufacture and lower production cost.

DESCRIPTION OF THE DRAWINGS

Following is a more detailed description of the invention as illustrated by the accompanying drawing, in which.

Figure 1:
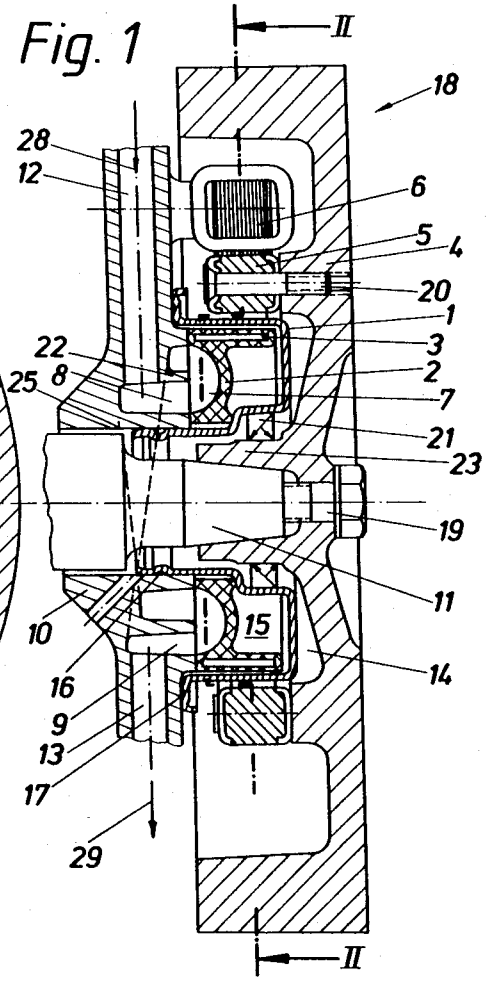
FIG. 1 is a vertical section of the part of an internal combustion engine relevant to the invention, according to line I—I in FIG. 2.
Figure 2:
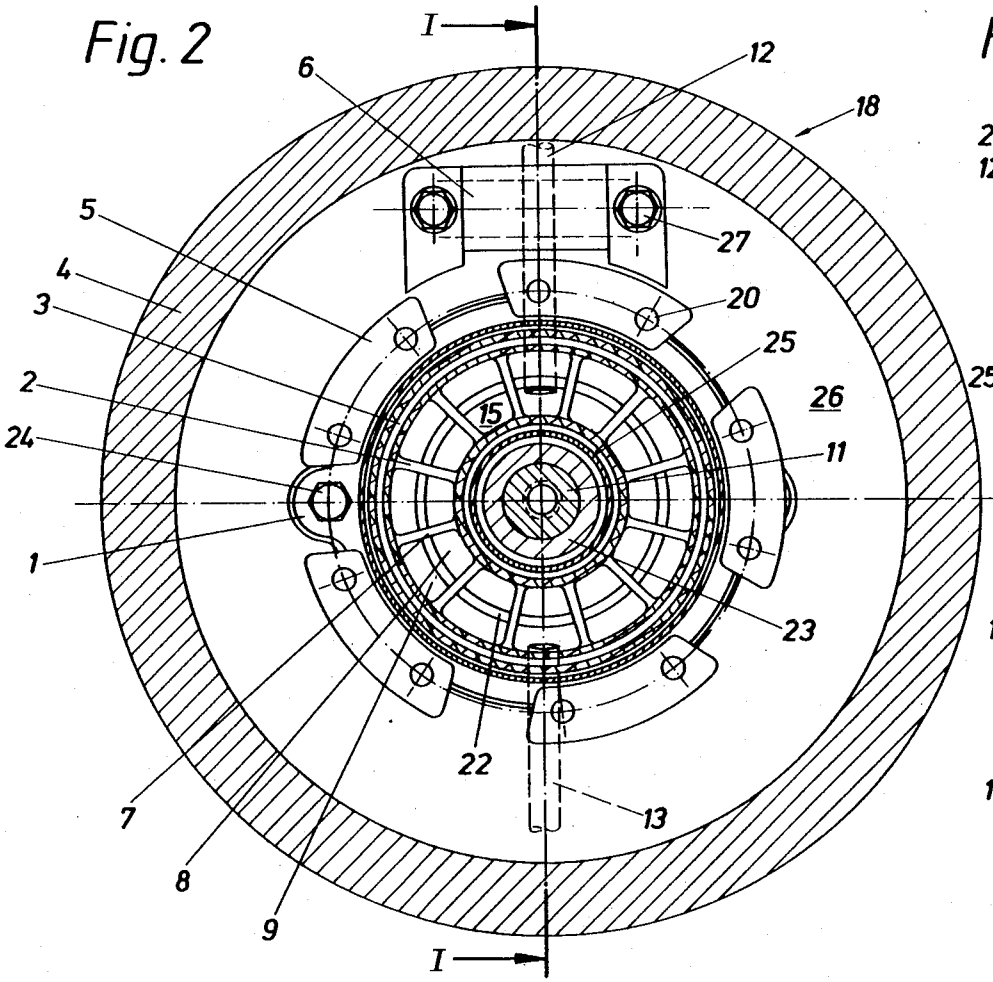
FIG. 2 is a section according to line II—II in FIG. 1.

On the end of the crankshaft 11 projecting from the crankcase 10 of an internal combustion engine (not shown here) the flywheel 4 is centered and fastened by means of an axial screw 19. Together with the armature 6 fastened to the crankcase 10 by screws 27 the permanent magnets 5 which are directly attached to the flywheel 4 by means of screws 20, form the flywheel generator 18 of the internal combustion engine.

The ring-shaped recess 14 of the flywheel 4, which is open towards the crankcase 10, contains the housing 1 of the water pump 15 attached to the crankcase 10. The housing 1 is fastened to the crankcase 10 with screws 24; it is sealed against the outer wall 26 of the crankcase 10 by a seal 17, and against the opening 25 where the crankshaft 11 penetrates the crankcase 10 by means of a seal 16. In the housing 1 the impeller 2 of the water pump 15 is floating. The impeller 2 which has radial blades 7 on the side of the engine comprises an element of sheet metal configured as a squirrel cage rotor 3. The inlet and outlet lines 12 and 13 as well as the intake channel 8 and the pressure channel 9 of the water pump 15 are located in the outer wall 26 of the crankcase 10.

Along the arrow 28 in the inlet line 12 the water flows into the inner circular intake channel 8 which is open towards the impeller 2. Via the rotatory field generated by the rotating permanent magnets 5 the squirrel cage rotor 3 and the impeller 2 of the water pump 15 connected with the rotor 3 are driven, and the water is pumped by the radial blades 7 of the impeller 2 into the circular pressure channel 9, which is separated from the channel 8 by a concentric web 22 and is also open towards the impeller 2, and from which the water flows off through the outlet line 13 in the direction indicated by arrow 29. The gap between the hub 23 of thy flywheel 4 and the housing 1 of the water pump 15 is sealed by a rotary shaft seal 21.

I claim:

1. An internal combustion engine comprising an engine housing, a flywheel generator with rotating permanent magnets and a cooling-water pump, whose housing is attached to said engine housing, said water pump comprises an impeller and a squirrel cage rotor which is rigidly connected with said impeller and can be driven without physical contact via the rotatory field of said permanent magnets, wherein said housing of said water pump with its impeller is placed in a concentric recess of said generator flywheel that is positioned next to said permanent magnets.

2. An internal combustion engine according to claim 1, wherein said housing of said water pump is located within the enveloping surface formed by said rotating permanent magnets.

3. An internal combustion engine according to claim 1 or 2, wherein said impeller of said water pump is configured as a plastic component into which said squirrel cage rotor is integrated.

* * * * *